US008052546B1

(12) United States Patent
Nagel et al.

(10) Patent No.: US 8,052,546 B1
(45) Date of Patent: Nov. 8, 2011

(54) BASKETBALL SHOOTING TRAINING AID WITH AUTOMATICALLY ENGAGEABLE WRISTLET COUPLERS

(76) Inventors: Christopher D. Nagel, Santa Ana, CA (US); William Jason Wright, Wilmington, CA (US)

( * ) Notice: Subject to any disclaimer, the term of this patent is extended or adjusted under 35 U.S.C. 154(b) by 0 days.

(21) Appl. No.: 12/460,467

(22) Filed: Jul. 20, 2009

(51) Int. Cl.
*A63B 69/00* (2006.01)

(52) U.S. Cl. ..... 473/450; 473/422

(58) Field of Classification Search ..... 473/422, 473/450, 458, 464, 438, 451, 212–217
See application file for complete search history.

(56) References Cited

U.S. PATENT DOCUMENTS

| | | | | | |
|---|---|---|---|---|---|
| 1,655,092 | A | * | 1/1928 | Davis | 473/212 |
| 4,239,228 | A | * | 12/1980 | Norman et al. | 473/212 |
| 4,377,284 | A | | 3/1983 | Okerlin | |
| 4,747,779 | A | * | 5/1988 | Gerstung | 434/247 |
| 4,892,317 | A | * | 1/1990 | Corder, Jr. | 473/212 |
| 5,005,833 | A | | 4/1991 | Groveman et al. | |
| 5,016,885 | A | * | 5/1991 | Quigley | 473/217 |
| 5,143,371 | A | * | 9/1992 | Strahan | 473/285 |
| 5,538,253 | A | * | 7/1996 | Foster | 273/108.21 |
| 5,601,285 | A | * | 2/1997 | Baxter, III | 473/458 |
| 5,807,218 | A | | 9/1998 | Nagatomo | |
| 5,816,952 | A | | 10/1998 | Blevins | |
| 5,938,548 | A | | 8/1999 | Upshaw | |
| 6,095,936 | A | | 8/2000 | Kirkpatrick et al. | |
| 6,203,453 | B1 | | 3/2001 | Coddens | |
| 6,283,877 | B1 | | 9/2001 | Cook | |
| 6,537,160 | B2 | | 3/2003 | Chrystal | |
| 6,755,755 | B2 | | 6/2004 | Wah Loh | |
| 6,773,366 | B2 | | 8/2004 | Gray | |
| 6,846,254 | B2 | | 1/2005 | Baxter | |
| 6,984,184 | B2 | | 1/2006 | Gray | |
| 7,172,522 | B1 | | 2/2007 | Harvey | |
| 7,381,140 | B1 | | 6/2008 | Stanisic | |
| 7,399,240 | B2 | | 7/2008 | Paukert et al. | |
| 2008/0214330 | A1 | | 9/2008 | Goebel | |

* cited by examiner

*Primary Examiner* — Mitra Aryanpour
(74) *Attorney, Agent, or Firm* — William L. Chapin

(57) ABSTRACT

A basketball shooting training aid for releasably limiting to a predetermined maximum length the span distance between a basketball player's shooting or launch hand and guide hand comprises a pair of elastic wristlet bands secureable around opposite wrists of the player. Each wristlet has protruding outwardly therefrom a flexible, longitudinally elongated stalk which has at the outer end thereof a coupler releasably engageable with the other coupler. In a preferred embodiment, each coupler includes a permanent magnet having a longitudinally outwardly extending magnetic field of opposite polarity to that of the opposite coupler, thus enabling the couplers to automatically engage when outer ends of the stalks are brought sufficiently close to each other, e.g., about 2 inches, and to automatically disengage when a tensional parting force of a predetermined value, e.g., about 6 pounds is exerted on the couplers by drawing the wrists apart.

21 Claims, 8 Drawing Sheets

BASKETBALL SHOOTING TRAINING AID WITH AUTOMATICALLY ENGAGEABLE WRISTLET COUPLERS

BACKGROUND OF THE INVENTION

A. Field of the Invention

The present invention relates to physiological conditioning and training of people desirous of becoming proficient in athletic games. More particularly, the present invention relates to a device for aiding beginning basketball players in acquiring motor skills needed to accurately launch or "shoot" a basketball into a distant basket.

B. Description of Background Art

The game of basketball, as well as other athletic activities, requires a particular set of human motor skills for a person to achieve a reasonable level of proficiency at playing the game. Since the goal of a basketball game is to score a maximum number of points by players' launching or shooting a basketball from a location on the playing floor into a basket, acquiring shooting skill is an essential goal of a beginning basketball player.

Usually, a basketball is launched towards a basket by grasping opposite sides of the ball between the palms of a player's hands, with the forearms retracted upwardly and rearwardly towards the shoulders of the player to thus flex the elbow joints into laterally spaced apart, generally parallel, V-shaped configurations. One forearm, such as the right forearm of a right-handed player, is twisted inwardly slightly towards a vertical longitudinal center plane of the person's body, to thus position the palm of one hand against the rear side of the ball. The hand contacting the rear surface of the ball, called the shooting or launch hand, is then thrust forward, thereby unbending the shooting arm elbow to a more generally straight, forwardly pointing configuration, and thus launching the ball into an upwardly and forwardly curved, arc-shaped trajectory.

Just prior to launching a basketball as described above, the player's other hand, referred to as the guide hand and being the left hand in the case of a right-handed player, is positioned in a generally vertical position, pressed lightly against the left side of the the left, guide hand, desirably is maintained on the ball until it is thrust forward from the finger tips of the right, launch hand. Maintenance of a guiding force on the ball until it is launched ensures that the azimuthal launch angle determined by the player to be aligned with a distant basket will be maintained.

However, in practice, it has been found that beginning basketball players routinely make a common mistake which results in unsatisfactory shooting performance in basketball, as well as other sports. Specifically, beginning basketball players often fail to follow-through in shooting a ball towards a basket. Thus, it is a common tendency of a beginning basketball player to prematurely drop the guide hand before a ball has been launched forward away from the tips of the launch hand. This premature removal of a lateral guiding force by the guide hand frequently results in the launched ball deviating left or right from an intended trajectory, and therefore resulting in a shot which deviates left or right of the basket centerline.

In apparent recognition of the problematic lack of follow-through of the guide hand displayed by beginning basketball players, a number of devices have been disclosed which are intended to aid beginning basketball players in learning how to accurately shoot a basketball into a basket. The devices include Okerlin, U.S. Pat. No. 4,377,204, Blevins, U.S. Pat. No. 5,916,652 and Goeble, U.S. Patent Application No. 2008/0214330, all of which disclose devices for maintaining a basketball player's hands in close proximity while making a practice shot. Chrystal, U.S. Pat. No. 6,537,160 discloses a teaching device for facilitating an orientation of a person's hands prior to performing a task such as catching a ball. Stanisic, U.S. Pat. No. 7,381,140 discloses a tennis teaching instruction aid which includes wrist bands for encircling the wrists of a user and an umbilical that fits between the wrist bands to maintain the hands at a maximum distance. Baxter, U.S. Pat. No. 6,846,254 discloses a breakaway sports training device which includes a pair of wrist straps connected by a strap which has a breakaway attachment means that enables the wrists to be freed from constraint at a predetermined breakaway tension.

The present invention was conceived of to provide a basketball shooting training aid which is effective in performing muscle memory habit conditioning for the purpose of achieving proficiency in shooting baskets, and which overcomes certain limitations of prior art devices.

OBJECTS OF THE INVENTION

An object of the present invention is to provide a training aid device to assist beginning basketball players in acquiring motor skills required for accurately launching or shooting a basketball into a basket.

Another object of the invention is to provide a basketball shooting training device which facilitates conditioning arm muscles of a beginning basketball player to move in a coordinated fashion effective in accurately shooting a basketball into a basket.

Another object of the invention is to provide a basketball shooting training aid device which is effective in conditioning muscle memory habits associated with effective basketball shooting.

Another object of the invention is to provide a basketball shooting training aid which is effective in maintaining a second one of a person's hands used to guide a basketball parallel to a first, launching hand used to thrust a basketball forwards toward a basket; as the launching hand is moved upwards and forwards to launch the ball in an arc-shaped trajectory towards a basket.

Another object of the invention is to provide a basketball shooting training aid which includes a pair of wrist bands fittable around the wrists of a basketball player during shooting practice, each of the wrist bands having protruding perpendicularly outwardly therefrom a flexible stalk terminated at an outer end thereof by a coupler releasably joinable to the coupler of the other stalk.

Another object of the invention is to provide a basketball shooting training aid which includes a pair of first and second flexible elastic wrist bands fittable over the wrists of a basketball player, each wrist band having protruding perpendicularly outwardly therefrom a flexible stalk terminated at an outer end thereof by a coupler including a magnet which is releasably engageable with a similar coupler terminating the other flexible stalk, the couplers being automatically engageable by an attractive magnetic force when the couplers are positioned in a relatively close, approximately axially aligned configuration, and automatically disengageable upon application of a tensional parting force of a predetermined magnitude, as for example should a player thrust the hands outwards to brace the body against impact from a fall.

Another object of the invention is to provide a basketball shooting training aid which includes a pair of first and second flexible wrist bands fittable over the left and right wrists of a basketball player, each wrist band having protruding perpendicularly therefrom a flexible stalk having at an outer end thereof a magnet magnetically attracted to a magnet on the outer end of the other stalk, one of the magnets being partially enclosed by an outwardly flaring, outwardly protruding cone for facilitating reception and automatic engagement of and retention to the magnet located at the outer end of the other stalk.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends a training aid device wearable by a basketball player to assist the player in acquiring and maintaining motor skills in shoulder, arm, elbow, wrist and hand muscles which are required for accurately and consistently shooting a basketball into a basket.

The basketball shooting training aid according to the present invention includes a pair of wristlets which are substantially identical in construction and fittable interchangeably over left and right wrists of a basketball player. Each wristlet includes an elastically flexible cylindrically-shaped flat wrist band, preferably made of an elastically stretchable fabric. Also, each wrist band has protruding perpendicularly from a longitudinally centered location of an outer cylindrical wall surface thereof an elongated, flexible stalk. Each stalk has generally the shape of an elongated, uniform cross-section beam or rod. The stalk is made of a material such as an elastomeric polyurethane which has sufficient rigidity for an inner length of the stalk to maintain perpendicularity to the wrist band, but has sufficient flexibility for an outer length of the stalk to bend readily, thus allowing the outer length of the stalk to droop under the force of gravity.

Each of the stalks desirably has a substantially identical length and construction, and has at an outer end thereof a short, enlarged diameter cylindrical bulb-shaped coupler housing which has fixed coaxially within a cylindrical bore within the bulb a cylindrically-shaped, axially magnetized magnet. The magnet fixed in the coupler housing of one stalk has an outwardly facing North magnetic polarity, while the magnet in the other coupler has an outward facing South pole. Thus, when the coupler housing bulbs of the two stalks are brought relatively close to one another, the two magnets are attracted together into contacting engagement.

With the magnets of the couplers of the device thus engaged, the maximum span distance between the wrists of a player, and hence the hands, is maintained at a suitable maximum distance. Limiting the maximum span distance between the player's wrists ensures that when a first, launch hand of the player is used to launch a basketball, the other, guide hand will remain in contact with the side of the basketball opposite the launching hand. Retention of the guide hand at a fixed maximum lateral spacing from the launch hand during the entire thrusting motion of the launch arm and hand to shoot a ball towards a basket helps to achieve proper follow-through of the guide arm and hand. Moreover, repeated use of the training aid device according to the present invention results in muscle memory training conditioning. Thus, after a player has used the training aid a sufficient number of times, the player's muscles will automatically perform desired follow-through motions, even when the training aid device is no longer used.

Advantageously, the novel use of magnets as coupling elements in the training aid of the present invention enables the player to quickly and automatically couple the stalks of the device when switching from dribbling exercises to shooting exercises. Automatic or self-coupling engagement of the couplers is accomplished by merely bringing the wrists together to thus position the couplers at the ends of the stalks in close proximity to one another. Moreover, the coupling force between the magnets is desirably set to a particular value, such as about 6 pounds force, so that the stalks may be disengaged readily when desired, or if the player should thrust his arms outwards suddenly to brace himself from an accidental fall.

According to another novel aspect of the invention, the tubular bulb-shaped coupler housing at the outer end of one stalk has fitted coaxially over the housing an outwardly protruding, outwardly flaring frusto-conically-shaped guide sleeve or cone. The guide sleeve serves a dual function of facilitating automatic engagement of the coupler magnets, and retention of the coupled magnets in axial alignment with one another.

DESCRIPTION OF THE PREFERRED EMBODIMENTS

FIGS. 1-18 illustrate a basketball shooting training aid device with automatically engageable wristlet couplers according to the present invention.

Figure 1:
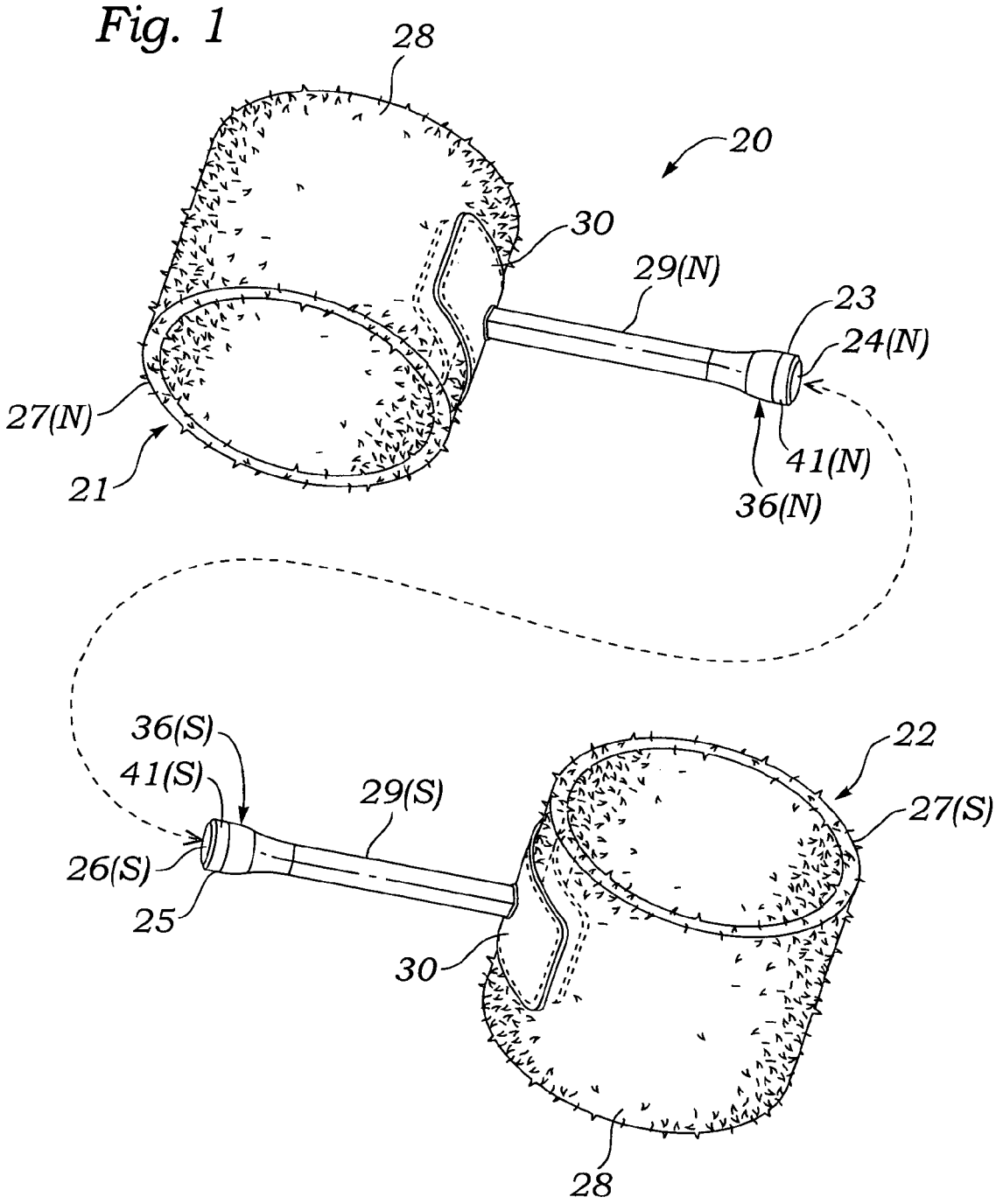
FIG. 1 is a perspective view showing a pair of similarly constructed wristlets comprising a basketball shooting training aid device according to the present invention.
Figure 2:
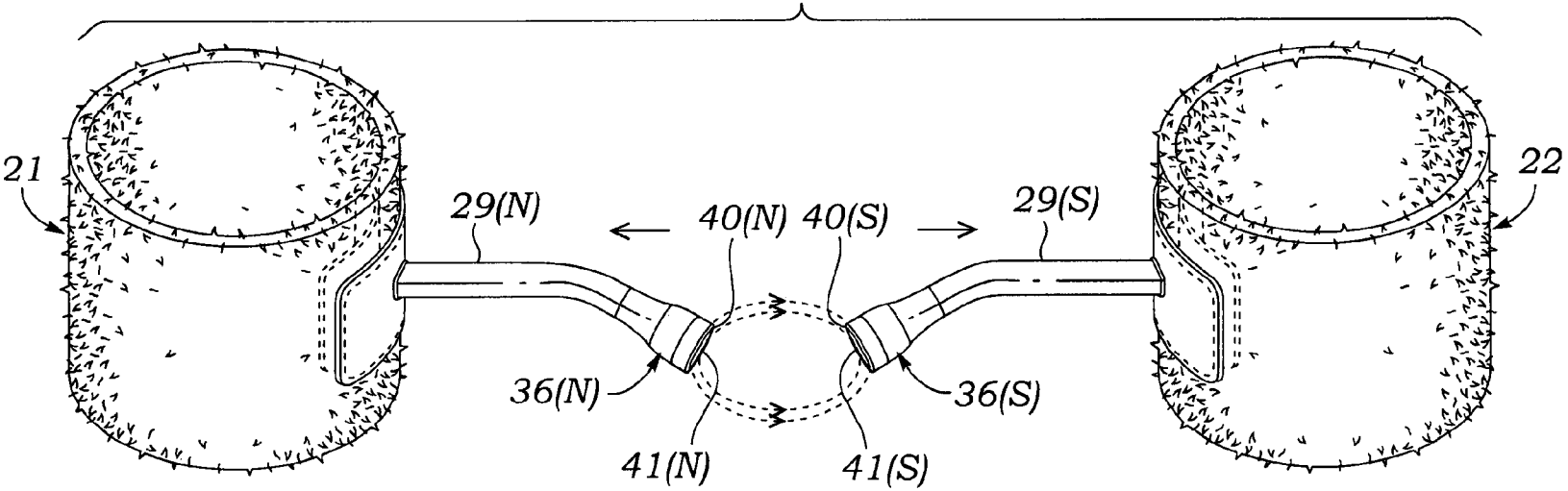
FIG. 2 is a perspective view of the device of FIG. 1, showing the wristlets disengaged from one another to facilitate attaching wrist bands of the wristlets to left and right wrists of a basketball player.

Referring first to FIGS. 1 and 2, it may be seen that a basketball shooting training aid device 20 with automatically engageable wristlet couplers according to the present invention includes a pair of wristlets 21, 22 which are substantially identical in appearance and construction. As will be described in detail below, in a basic embodiment of the invention, one of the wristlets, e.g., wristlet 21, includes a magnet 23 having at an outer face 24 thereof a North magnetic pole, while the other wristlet, e.g., wristlet 22 includes a magnet 25 having at an outer face 26 thereof a South magnetic pole.

Aside from the polarity difference of magnets 23, 25, wristlets 21, 22 of basic embodiment of device 20 have an identical construction. Therefore, in the ensuing description of the device 20, corresponding elements of the two wristlets 21, 22 will be given the same reference description number, but with an N or S suffix to distinguish between the "North" and "South" wristlets. Thus, for example, as shown in FIGS. 1 and 2, device 20 includes a North wristlet 21 that has a flexible elastic arm band 27(N), and a South wristlet 22 that has a flexible arm band 27(S). In the ensuing description, the N or S suffixes will be omitted where that omission does not result in any ambiguity.

Referring now to FIGS. 3-6, in addition to FIGS. 1 and 2, it may be seen that each wristlet 21, 22 includes a flexible elastic wrist band 27, which is preferably made of an elastically stretchable fabric material such as terry cloth. In an example embodiment of training device 20, each elastic wrist band 27 was made of a terry cloth composed of about 80% cotton, 10% nylon and 10% spandex. Each wrist band 27 had a width of about 2¾ inches, and an unstretched inner diameter of about 2¼ inches.

Figure 6:
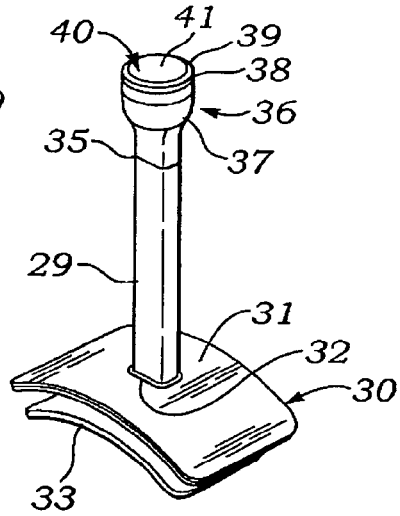
FIG. 6 is a fragmentary perspective view of the wristlet of FIG. 4.
Figure 7:
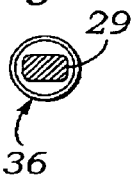
FIG. 7 is a transverse sectional view of the wristlet of FIG. 4, taken in the direction 7-7.

As may be seen best by referring to FIGS. 1-4, wristlets 21, 22 each have protruding perpendicularly outwardly from an outer cylindrical wall surface 28 thereof an elongated cross-section stalk 29. Stalk 29 preferably has a uniform transverse cross-sectional shape, which may be, for example, circular, rectangular, or triangular. As shown in FIGS. 6 and 7, each stalk 29 of an example embodiment of device 20 had horizontally elongated, rectangular cross-section.

Stalk 29 is preferably made of a soft, flexible material. In an example embodiment, stalk 29 was made of a soft, elastomeric polyvinyl chloride (PVC) polymer.

Figure 4:
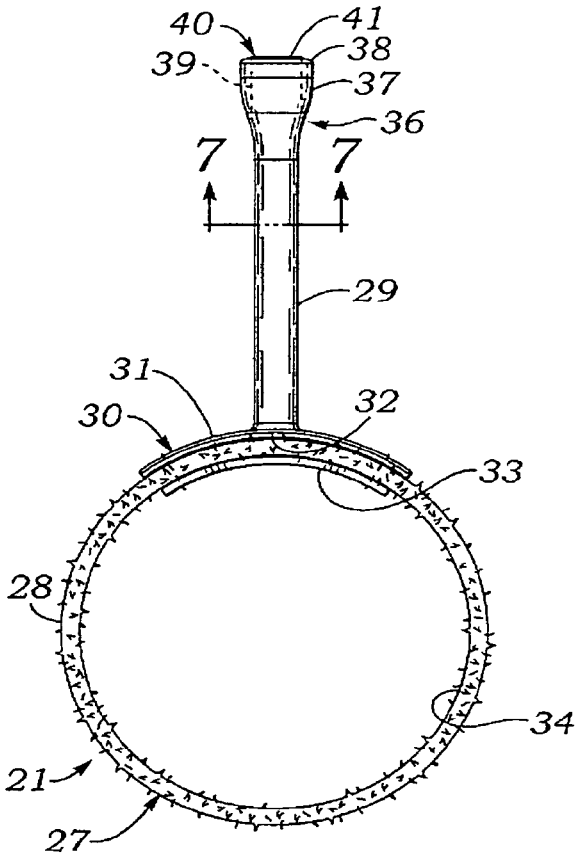
FIG. 4 is an end elevation view of one of the wristlets of the device of FIG. 1.
Figure 5:
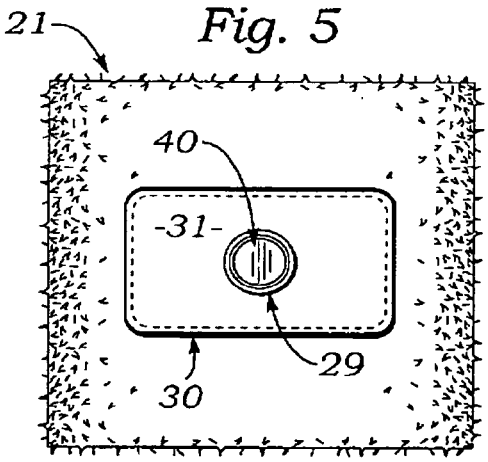
FIG. 5 is a side elevation view of the wristlet of FIG. 4.

As shown in FIGS. 4 and 6, stalk 29 is attached at an inner, base end thereof to the outer convexly curved face 31 of a curved rectangular base plate 30. As shown in FIGS. 4 and 5, base plate 30 of stalk 29 has in end elevation view the shape of a uniform thickness section of the wall of a cylindrical tube. In an example embodiment of training aid device 20, base plate 30 was made of PVC material which had a uniform thickness of about 2-3 mm and was attached to inner transverse face 32 of stalk 29 by being integrally molded with the stalk.

Referring to FIGS. 4 and 6, it may be seen that each wristlet 21, 22 includes a thin, curved anchor plate 33 which has a shape and size similar to that of stalk base plate 30. In an example embodiment, anchor plate 33 was made of a sheet of PVC of the same type and size as base plate 30.

Anchor plate 33 is positioned in parallel alignment with base plate 30, on an inner cylindrical wall surface 34 of wrist band 27. Stalk base plate 31 is secured to elastic wrist band 27 and inner anchor plate 33 by sewn stitches which penetrate each of those components, the stitches being concentric with the peripheral edges of the base plate.

Referring to FIGS. 4 and 6, it may be seen that stalk 29 has located at an outer end 35 thereof a coupler 36 which includes an enlarged diameter, cylindrical bulb-shaped coupler housing 37. Coupler housing is preferably made of a polymer which is somewhat harder than stalk 29, such as ABS plastic, and is bonded to the outer end of the stalk by suitable means, such as adhesive, ultrasonic or thermosonic bonding. Coupler housing 37 has protruding longitudinally inwards from an outer transverse end face 38 thereof a coaxial cylindrically-shaped bore 39. A cylindrically-shaped magnet 40 fits conformally within bore 40, and is secured therein by suitable fastening means, such as an epoxy adhesive.

As shown in FIGS. 4 and 6, magnet 40 has an outer transverse end face 41 which preferably protrudes outwardly a short distance from end face 38 of coupler housing 37. Magnet 40 preferably is axially magnetized, i.e., having a first magnetic pole, e.g., a North pole located at one end face of the magnet, such as at outer face 41, and a second magnetic pole, e.g., a South magnetic pole located at longitudinally inwardly located face 42 of the magnet.

Figure 3:
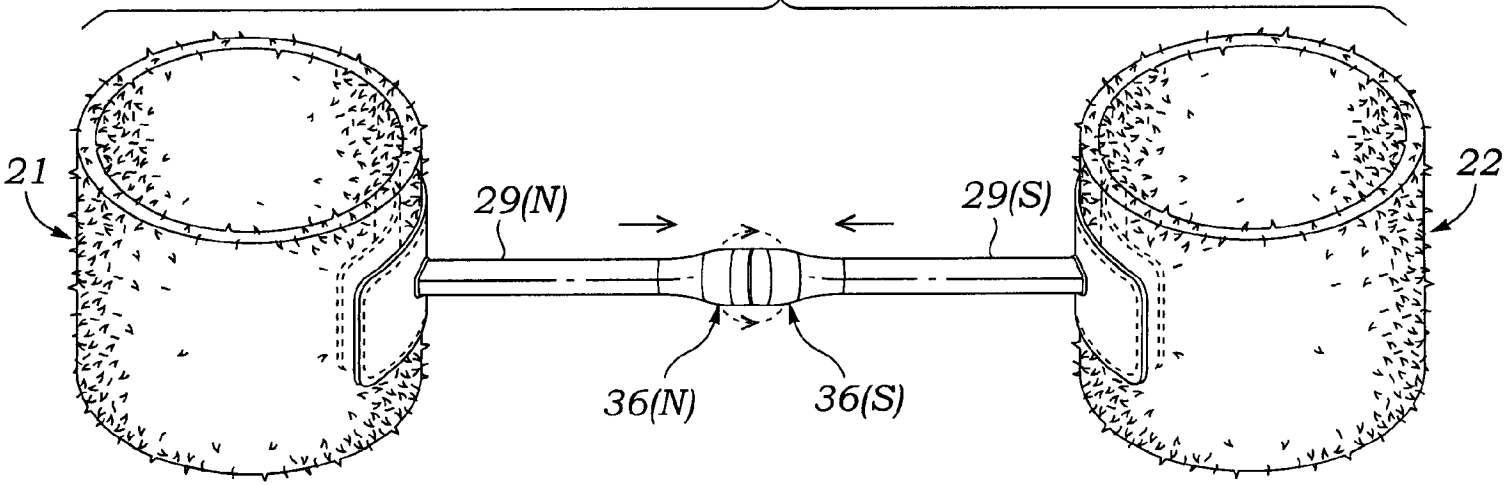
FIG. 3 is a view similar to that of FIG. 2, showing stalks of the two wristlets magnetically coupled to one another.

FIGS. 2 and 3 illustrate how the novel construction of training aid device 20 facilitates automatic engagement of couplers 36(N), 36(S) with one another. As shown in FIG. 3, when the separation distance between magnets 40(N), 40(S) at the outer ends of couplers 36(N), 36(S) is reduced to a sufficiently small value, e.g., about 1 inch, a magnetic force of attraction between the oppositely poled magnets causes them to be drawn together until outer transverse faces 41(N), 41(S) of the magnets are drawn into congruent abutting contact, thus adhering the magnets and attached stalks 29(N), 29(S) into conformal abutting contact. In this configuration, stalks 29(N), 29(S) are axially aligned to thus form a continuous flexible link between wristlets 21, 22.

Figure 8:
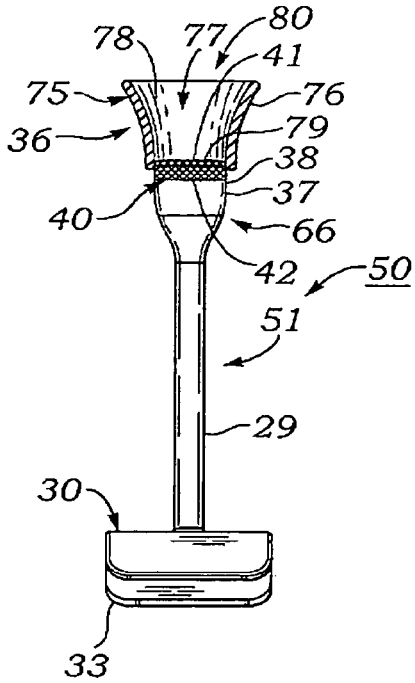
FIG. 8 is a fragmentary partly sectional side elevation view of a preferred modification of one wristlet of the device of FIG. 1, in which a coupler housing of one of the wristlets includes an engagement guide cone.

FIG. 8 illustrates a modification 50 of training aid device 20 shown in FIGS. 1-6 and described above. As shown in FIG. 8, one of the wristlets, e.g., wristlet 21 is modified to a wristlet 51 which has added to coupler 66 thereof an axially outwardly protruding frusto-conically shaped sleeve or guide cone 75. As shown in FIG. 8, guide cone 75 has a thin generally uniform thickness wall 76 which peripherally encloses a tapered bore 77. Bore 77 has a tapered outer end length 78, and an inner cylindrically-shaped length 79.

Figure 9:
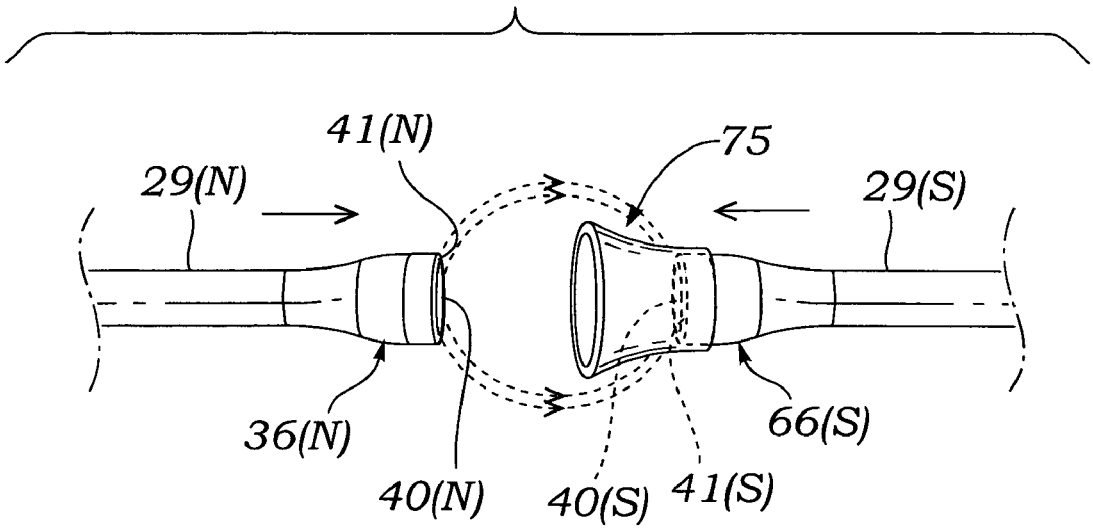
FIG. 9 is a perspective view showing a modified wristlet having the modified coupler shown in FIG. 8 preparatory to engagement with another wristlet.
Figure 10:
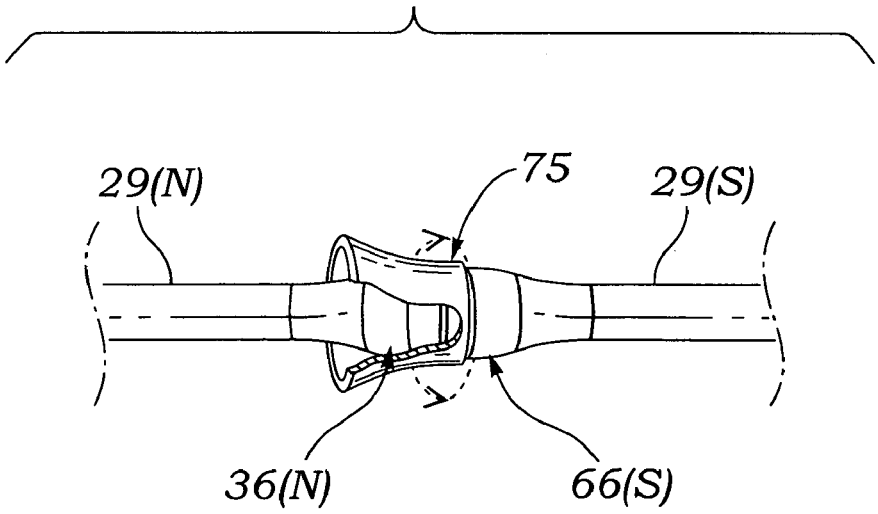
FIG. 10 is a view similar to that of FIG. 8, showing the stalks of the two wristlets magnetically coupled to one another.
Figure 11:
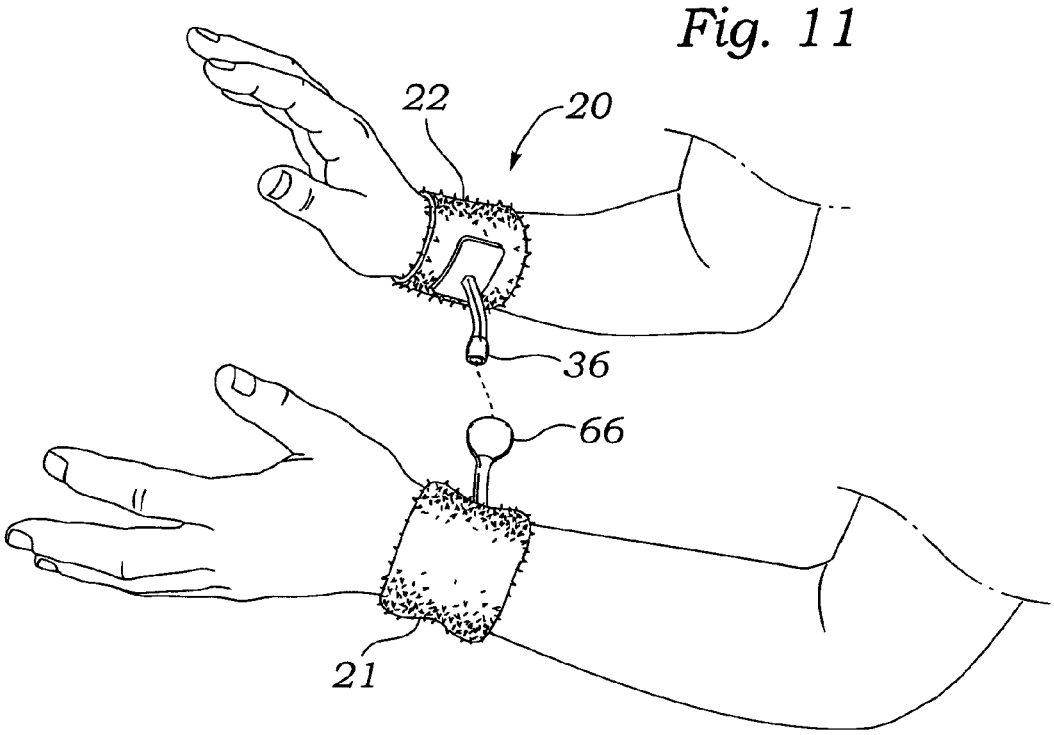
FIG. 11 is a perspective view showing the wristlets of the device of FIG. 1 or 8 placed around the wrists of a basketball player
Figure 12:
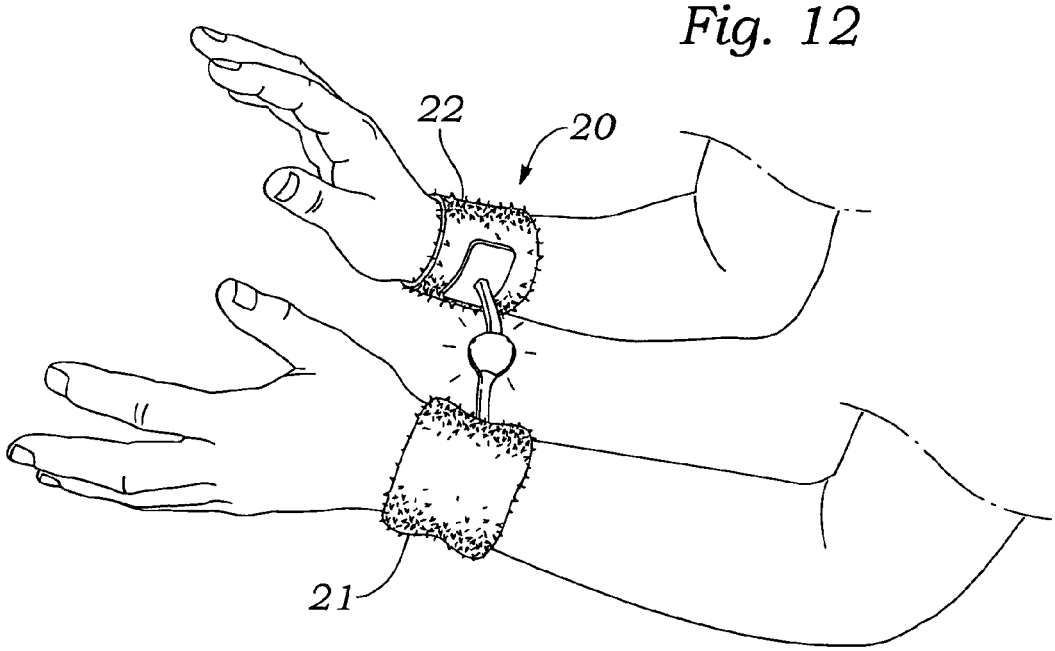
FIG. 12 is a perspective view showing the training device of FIG. 1 or 8 worn by a basketball player with couplers of the wristlets joined together preparatory to launching or shooting a basketball towards a basket.
Figure 13:
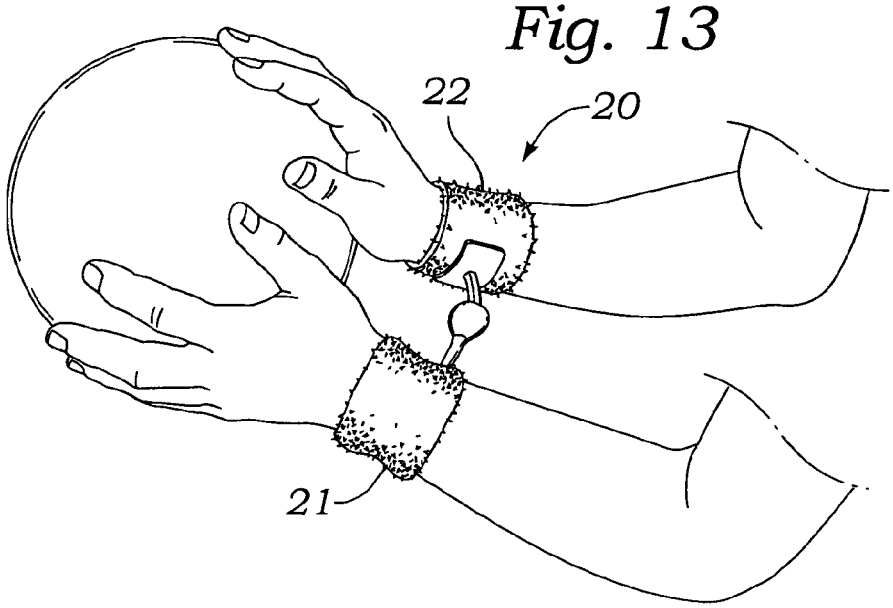
FIG. 13 is a view similar to that of FIG. 12 but showing a basketball grasped in the player's hands.
Figure 14:
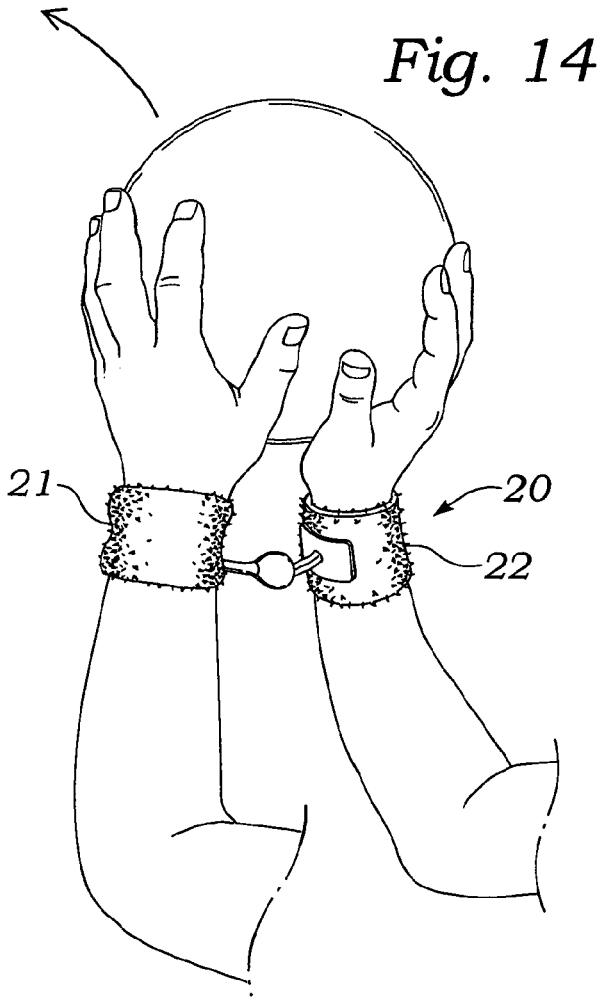
FIG. 14 is a view similar to that of FIG. 12, but showing a basketball grasped in the player's hands, and the arms raised, preparatory to propelling the basketball towards a basket.
Figure 15:
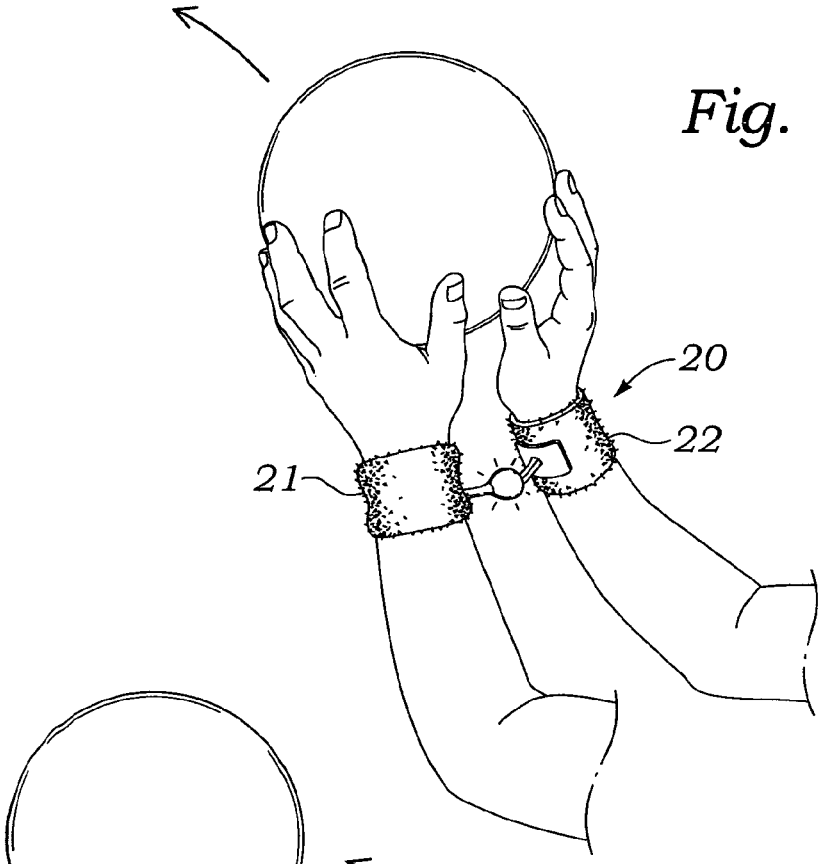
FIG. 15 is a view similar to that of FIG. 14, showing the configuration of the device and the player's hands at the beginning of the shot.
Figure 16:
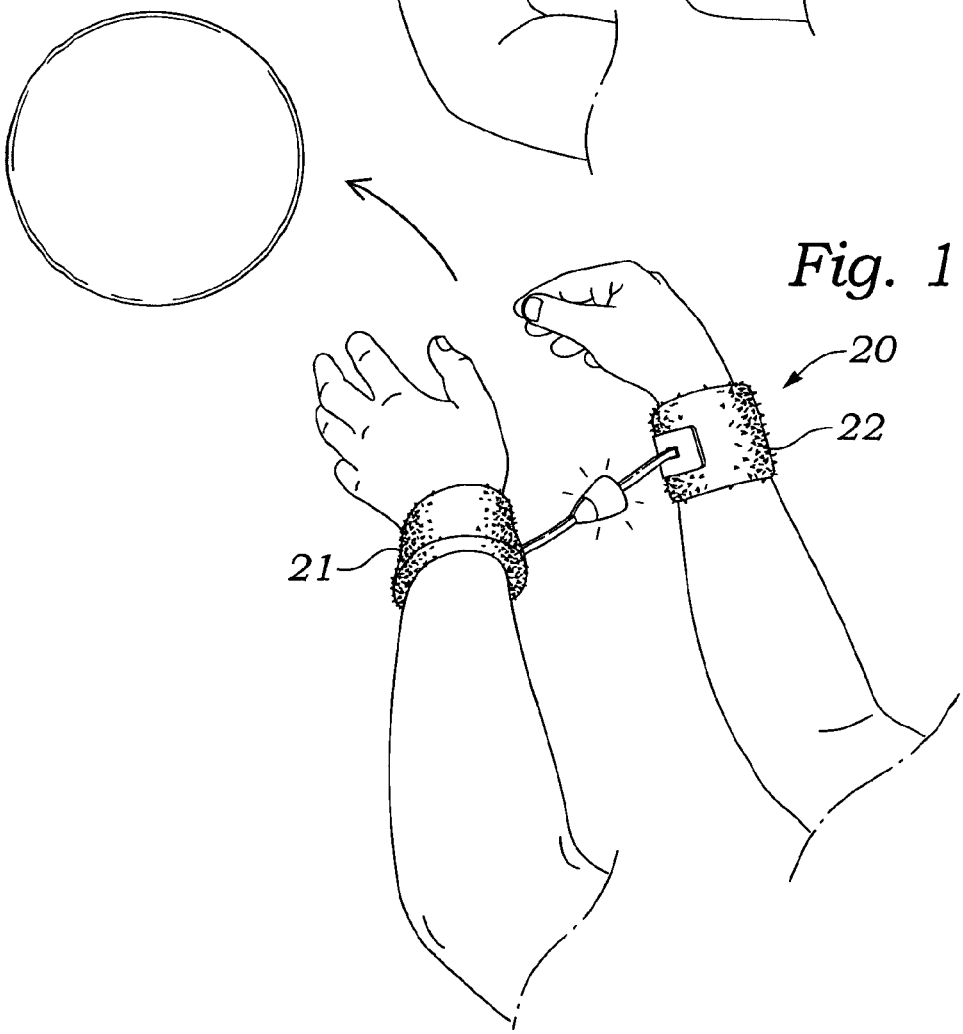
FIG. 16 is a view similar to that of FIG. 15, but showing the shooting hand and guide hand of the basketball player thrust forward to launch the ball
Figure 17:
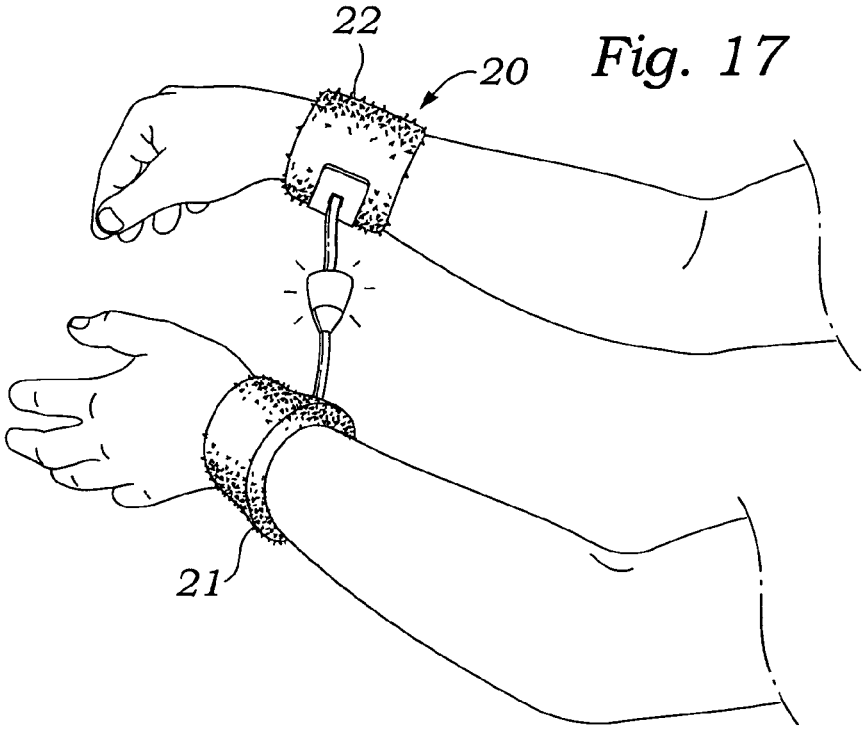
FIG. 17 is a view similar to that of FIG. 16, but showing the hands of the player dropped after the ball has been released.
Figure 18:
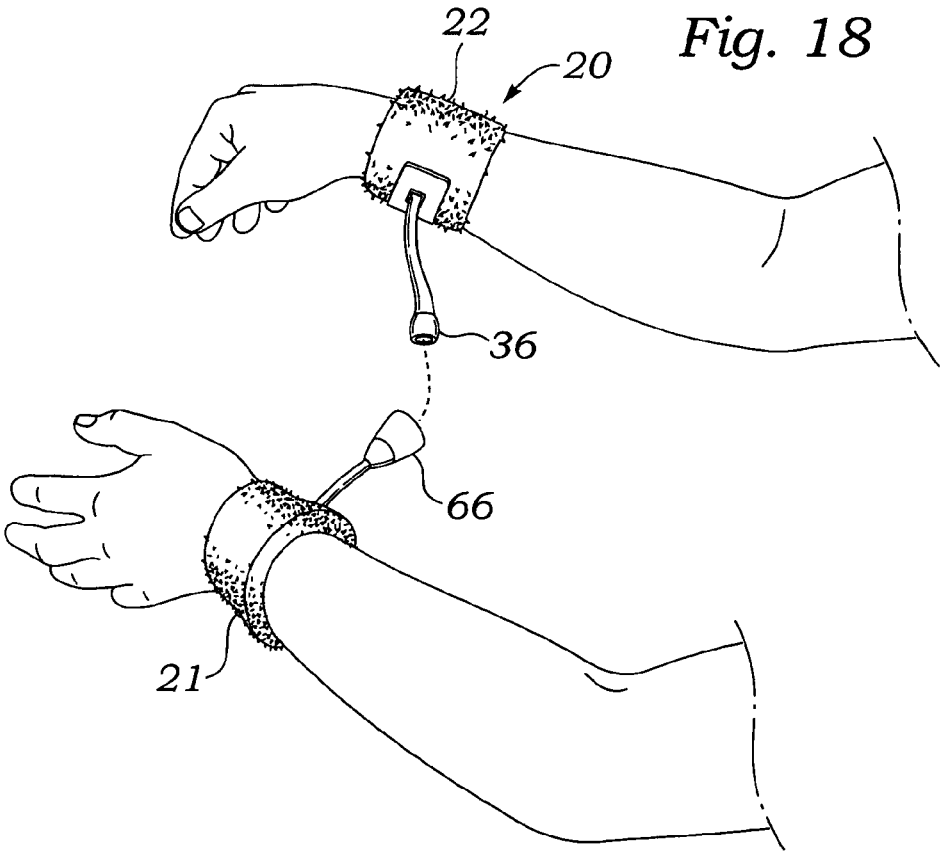
FIG. 18 is a view showing the hands moved apart to disengage couplers of the device from one another.

Guide cone 75 performs two novel and advantageous functions. First, as shown in FIGS. 9 and 10, when the wrists of a player are moved towards one another to cause coupler 66 to engage with coupler 36, the outer entrance opening 80 os guide cone 75 provides a large cross-section target into which coupler 36 may be inserted. Then, owing to the radially inwardly tapered wall surface 81 of the guide cone contacting coupler 36 as it is moved axially towards coupler 66, coupler 36 is guided radially inwards into axial alignment with coupler 66, thus facilitating contact and engagement of outer faces 41(N), 41(S) of the magnets 40(N), 40(S) of the couplers.

Second, with housing 37 of coupler 36 fitted coaxially within cylindrical inner bore 79 of guide cone 75, magnet 23(N) is prevented from being torqued into axial misalignment with magnet 23(S), thus ensuring that the magnets are not inadvertently separated.

FIGS. 11-18 illustrate how the stalks 29(N), 29(S) of device 20 or 50 are automatically engaged prior to shooting a basketball with the aid of the device, automatically disengaged when the arms are brought apart with a minimum separation force, and automatically re-engaged upon bringing the arms together again.

As shown in FIGS. 13-16, device 20 constrains the guide hand of a player to remain properly positioned at a limited maximum spacing from the shooting hand during the entire sequence of arm and hand motions entailed in shooting a basketball towards a basket. Although the maximum spacing between wristlets 21, 22 of device 20 would depend somewhat on the size of a player, the present inventors have found that a maximum spacing of about 4 to about 7 inches is satisfactory, with a preferred range of about 5 inches to about 6 inches. Thus the preferred overall length of stalks 29 is about 2½ inches to about 3 inches.

Optionally, the permanent magnet 40 of one coupler 36 may be replaced by a ferromagnetic body, such as a soft iron slug, which is not permanently magnetized and hence does not produce of itself a magnetic field, but which has a high magnetic permeability and hence is attracted to the permanent magnet 40 in the other coupler 36.

What is claimed is:

1. A basketball shooting training aid device for releasably limiting to a predetermined maximum value the span distance between a basketball player's shooting or launch hand and guide hand, said device comprising;

a. a first wristlet securable around a first wrist of a person, said first wristlet having protruding therefrom a first elongated flexible stalk, said stalk having at an outer transverse end thereof a first releasable coupler automatically engageable with a second releasable coupler, b. a second wristlet securable around a second wrist of a person, said second wristlet having protruding therefrom a second elongated flexible stalk, said stalk having at an outer transverse end thereof a second releasable coupler, and c. said first and second releasable couplers being so constructed as to be automatically engageable solely by positioning said couplers close to one another, and automatically disengageable solely upon exertion of a tensional parting force tending to separate said couplers;

wherein at least one of said first and second releasable coupler includes a first permanent magnet; and wherein at least one of said first and second releasable coupler includes a ferromagnetic body.

2. The device of claim 1 wherein said second coupler includes a second permanent magnet.

3. The device of claim 2 wherein said second permanent magnet has at least one magnetic pole which confronts a magnetic pole of said first permanent magnet of opposite polarity when said first and second couplers are positioned close to one another.

4. The device of claim 1 wherein said first permanent magnet has an Outer face disposed transversely to a longitudinal axis of said first stalk.

5. The device of claim 4 wherein said first permanent magnet has a longitudinally disposed magnetic axis, whereby an outer transverse face of said magnet has thereat a magnetic pole of a first magnetic polarity.

6. The device of claim 5 wherein said second releasable coupler includes a second permanent magnet which has an outer transverse face disposed transversely to a longitudinal axis of said second stalk, said outer transverse face of said second magnet having thereat a magnetic pole of polarity opposite that of said magnetic pole at said outer transverse face of said first magnet.

7. The device of claim 1 wherein said first releasable coupler has located at an outer end thereof a tubular, generally frustoconically shaped guide cone for insertably receiving said second coupler, said guide cone having at an inner transverse end thereof an inner diameter of an appropriate size for conformably receiving therein an outer periphery of said first coupler, and at an outer transverse end thereof a larger diameter.

8. The device of claim 1 wherein said wristlet includes a ring-shaped band.

9. The device of claim 8 wherein said band is further defined as being elastically stretchable to thus enable slipping said band over a person's hand and gripping a wrist of said person.

10. A basketball shooting training aid device comprising;

a. a first wristlet securable around a first wrist of a person, said first wristlet having protruding outwardly from an outer surface thereof a first longitudinally elongated flexible stalk, said stalk having at an outer end thereof a first releasable coupler including a first magnet effective in producing a longitudinally outwardly extending magnetic field of a first polarity, and b. a second wristlet securable around a second wrist of a person, said second wristlet having protruding outwardly from an outer surface thereof a second longitudinally elongated flexible stalk, said second stalk having at an outer end thereof a second releasable coupler including a second magnet effective in producing a longitudinally outwardly extending magnetic field of a second polarity opposite to that of said magnetic field of said first magnet; and c. said first and second releasable couplers being so constructed as to be automatically engageable solely by positioning said couplers close to one another, and automatically disengageable solely upon exertion of a tensional parting force tending to separate said couplers.

11. The device of claim 10 wherein said first and second magnets have faces disposed transversely to longitudinal axes of said first and second stalks, respectively, said outer faces having opposite magnetic polarities.

12. The device of claim 10 wherein said wristlets are each further defined as including an elastically deformable cylindrically shaped elastic band.

13. The device of claim 12 wherein each of said stalks protrudes outwards of an outer cylindrical wall surface of a said elastic band.

14. The device of claim 10 wherein each of said couplers is further defined as including a coupler housing located at an outer end of said stalk, said coupler housing having therein a bore in which is located a said magnet.

15. The device of claim 14 wherein said housing is further defined as having the shape of a bulbous body coaxially aligned with said stalk.

16. The device of claim 15 wherein one of said first and second coupler housings has protruding longitudinally outwards from an outer transverse end wall thereof a tubular, generally frustoconically shaped, longitudinally outwardly flared guide cone for insertably receiving the other of said coupler housing.

17. A basketball shooting training aid device comprising;

a. a first wristlet securable around a first wrist of a person, said first wristlet including a first elastically stretchable wrist band and a first flexible, longitudinally elongated stalk, said first stalk protruding outwards from a first base plate fixed to an outer circumferential wall surface of said wrist band, said first stalk having at an outer end thereof a first releasable coupler including a first magnet effective in producing a first longitudinally outwardly extending magnetic field of a first polarity; and b. a second wristlet securable to a second wrist of a person, said second wristlet including a second elastically stretchable wrist band, and a second flexible, longitudinally elongated stalk, said second stalk protruding outwards from a second base plate fixed to an outer circumferential wall surface of said second wristband, said second stalk having at an outer end thereof a second releasable coupler including a second magnet effective in producing a second longitudinally outwardly extending magnetic field of a second polarity opposite to that of said first magnetic field, said first and second magnetic fields being effective in attracting said first and second releasable couplers into axially aligned releasable engagement solely by positioning said couplers close to one another, and enabling mutual disengagement of said couplers solely upon exerting an outwardly directed tensional parting force on said couplers.

18. The device of claim 17 wherein each of said wristlets further includes a thin anchor plate fixed to an inner circumferential wall surface of a said wrist band, said anchor plate being parallel to and fastened to said base plate.

19. The device of claim 17 wherein each of said couplers is further defined as including a coupler housing located at an outer end of said stalk, said coupler housing having located at an outer end thereof a said magnet.

20. The device of claim 19 wherein said housing is further defined as having the shape of a bulbous body coaxially aligned with said stalk.

21. The device of claim 19 wherein one of said first and second coupler housings has protruding longitudinally outwards from an outer transverse end wall thereof a tubular, generally frustoconically shaped, longitudinally outwardly flared guide cone for insertably receiving the other of said coupler housings.

* * * * *